US012733693B1

(12) United States Patent
Hvalshagen

(10) Patent No.: US 12,733,693 B1
(45) Date of Patent: Sep. 15, 2026

(54) SYSTEM AND METHOD FOR CREATING CUSTOM FIT BRAS

(71) Applicant: Merete Hvalshagen, Centerville, OH (US)

(72) Inventor: Merete Hvalshagen, Centerville, OH (US)

( * ) Notice: Subject to any disclaimer, the term of this patent is extended or adjusted under 35 U.S.C. 154(b) by 0 days.

(21) Appl. No.: 19/187,781

(22) Filed: Apr. 23, 2025

(51) Int. Cl.
*A41C 3/12* (2006.01)
*A41C 3/00* (2006.01)

(52) U.S. Cl.
CPC ..... *A41C 3/0071* (2013.01); *A41C 3/12* (2013.01)

(58) Field of Classification Search
CPC ..... A41C 3/0071; A41C 3/12
See application file for complete search history.

(56) References Cited

U.S. PATENT DOCUMENTS 2,654,091 A * 10/1953 Nelson ..... A41C 1/06 450/32
3,425,420 A * 2/1969 Steinberger ..... A41C 3/0071 450/82
5,938,500 A * 8/1999 Hampton ..... A41C 1/06 450/32
6,319,092 B1 * 11/2001 Leyhe ..... A41C 3/0071 450/36
6,439,959 B1 8/2002 Magrone et al.
6,575,811 B1 * 6/2003 Fildan ..... A41C 3/122 450/41
6,746,306 B2 6/2004 Brothers
7,309,276 B2 12/2007 Legaspi et al.
7,648,408 B2 * 1/2010 Lung ..... A41C 3/12 450/58
12,161,174 B2 12/2024 Moldstad
2002/0193046 A1 * 12/2002 Zebersky ..... A63H 3/52 446/108
2003/0060125 A1 * 3/2003 Boser ..... A41C 3/0007 450/41

(Continued)

FOREIGN PATENT DOCUMENTS

ES 1225474 U 2/2019
GB 2567574 B 10/2019

(Continued)

OTHER PUBLICATIONS

The Bra Lab, "Bra Lab Convertible Bras for Women—Multiway Bra Cup—Plunge, Push Up, Plus", https://www.amazon.in/Bra-Lab-Convertible-Bras-Women/dp/B082MS6VHY, retrieved Apr. 16, 2025, 3 pgs.

*Primary Examiner* — Gloria M Hale
(74) *Attorney, Agent, or Firm* — Kolisch Hartwell, P.C.

(57) ABSTRACT

A system for creating a custom fit bra for a wearer includes bra bands, first cups, and second cups. Each bra band of the plurality of bra bands includes a frame and a pair of wings extending oppositely away from the frame to be wrapped around a torso of the wearer. The frame defines a first engagement surface and a second engagement surface. Each first cup defines a first mating surface removably attachable to the first engagement surface facilitating the first cups to be interchangeably coupled with the frame associated with each bra band. Each second cup defines a second mating surface removably attachable to the second engagement surface facilitating the second cups to be interchangeably coupled with the frame associated with each bra band.

20 Claims, 4 Drawing Sheets

(56) References Cited

U.S. PATENT DOCUMENTS

| | | | | |
|---|---|---|---|---|
| 2010/0297913 | A1* | 11/2010 | Liegey ..... | A41C 3/0071<br>450/39 |
| 2024/0381951 | A1 | 11/2024 | Muhlenfeld | |

FOREIGN PATENT DOCUMENTS

| | | | |
|---|---|---|---|
| JP | 2003328206 | A | 11/2003 |
| JP | 2005163246 | A | 6/2005 |
| KR | 200393602 | Y9 | 8/2005 |

* cited by examiner

SYSTEM AND METHOD FOR CREATING CUSTOM FIT BRAS

BACKGROUND

Technical Field

The present disclosure relates, generally, to a system and method for creating custom fit bras for wearers, and, more particularly, relates to bra fitting segments that can be worn by wearers enabling them to select a combination of the segments, based on which a bra template can be arrived at to produce a custom fit bra for the wearer.

Description of the Prior Art

A bra or brassiere, a garment generally used to cover a wearer's breasts, functions well when the wearer deems the bra to provide a good fit. Components of a bra that generally factor in achieving the good fit for the wearer is the bra band and the individual bra cups (e.g., both the right and left cups). However, bras, such as ready-to-wear bras, often fail to adapt to a variety of body styles, for example body styles that include a relatively narrow rib cage with relatively large sized breasts, and, conversely, to body styles that include a relatively wide rib cage with relatively small sized breasts. Other fit issues include non-equal sized left and right breasts and matching the cup to the unique shape of each breast. All these challenges make it difficult for a wearer outside the standard range of sizes to find a well-fitting bra.

SUMMARY

In one aspect of the disclosure, a system for creating a custom fit bra for a wearer is disclosed. The system includes multiple bra bands, multiple first cups, and multiple second cups. Each bra band includes a frame and a pair of wings extending oppositely away from the frame to be wrapped around a torso of the wearer. The frame defines a first engagement surface and a second engagement surface. Each first cup defines a first mating surface removably attachable to the first engagement surface facilitating the first cups to be interchangeably coupled with the frame associated with each bra band. Each second cup defines a second mating surface removably attachable to the second engagement surface facilitating the second cups to be interchangeably coupled with the frame associated with each bra band.

In some additional, alternative, or selectively cumulative embodiments, each bra band includes a first slot adjacent to the first engagement surface and a second slot adjacent to the second engagement surface. The system further includes first wires and second wires. At least one first wire is insertable into the first slot of the corresponding bra band to provide structural stability to the corresponding bra band. At least one second wire is insertable into the second slot of the corresponding bra band to provide structural stability to the corresponding bra band.

In some additional, alternative, or selectively cumulative embodiments, the first cups, the second cups, and the bra bands, allow the wearer to determine a combination of a first cup, a second cup, and a bra band, that best fits the wearer, enabling the custom fit bra to be produced for the wearer based on the combination of the first cup, the second cup, and the bra band.

In some additional, alternative, or selectively cumulative embodiments, each first cup includes a unique first identifier, each second cup includes a unique second identifier, and each bra band includes a unique bra band identifier. This helps form a bra template.

In some additional, alternative, or selectively cumulative embodiments, each first cup is configured to cover at least a portion of a first breast of the wearer and each second cup is configured to cover at least a portion of a second breast of the wearer.

In some additional, alternative, or selectively cumulative embodiments, the first engagement surface and the first mating surface are attachable to each other by at least one of a first Velcro mechanism and a first hook and loop fastening mechanism. This helps form the bra template.

In some additional, alternative, or selectively cumulative embodiments, the second engagement surface and the second mating surface are attachable to each other by at least one of a second Velcro mechanism and a second hook and loop fastening mechanism. This helps form the bra template.

In some additional, alternative, or selectively cumulative embodiments, the first cups are of different first cup sizes, the second cups are of different second cup sizes, and the bra bands are of different bra band sizes. This enhances the modularity of the system.

In some additional, alternative, or selectively cumulative embodiments, the first cups include a common first cup shape, the second cups include a common second cup shape, and the bra bands include a common bra band shape. This helps form differently sized bra templates, but having similar overall shapes.

In some additional, alternative, or selectively cumulative embodiments, at least one of each first cup, each second cup, and each bra band are formed from a flexible material. The flexible material includes fabric.

In another aspect of the disclosure, a method for creating a custom fit bra for a wearer is disclosed. The method includes using multiple bra bands, multiple first cups, and multiple second cups. Each bra band includes a frame and a pair of wings extending oppositely away from the frame to be wrapped around a torso of the wearer. The frame defines a first engagement surface and a second engagement surface. Each first cup defines a first mating surface removably attachable to the first engagement surface facilitating the first cups to be interchangeably coupled with the frame associated with each bra band. Each second cup defines a second mating surface removably attachable to the second engagement surface facilitating the second cups to be interchangeably coupled with the frame associated with each bra band.

In some additional, alternative, or selectively cumulative embodiments, the method includes determining a combination of a first cup, a second cup, and a bra band, that best fits the wearer, and manufacturing the custom fit bra based on the combination of the first cup, the second cup, and the bra band.

In some additional, alternative, or selectively cumulative embodiments, each bra band includes a first slot adjacent to the first engagement surface and a second slot adjacent to the second engagement surface. The method further includes using first wires and second wires. To this end, at least one first wire is insertable into the first slot of the corresponding bra band to provide structural stability to the corresponding bra band and at least one second wire is insertable into the second slot of the corresponding bra band to provide structural stability to the corresponding bra band.

In some additional, alternative, or selectively cumulative embodiments, each first cup includes a unique first identifier, each second cup incudes a unique second identifier, and each bra band includes a unique bra band identifier. This helps form a bra template.

In some additional, alternative, or selectively cumulative embodiments, each first cup is configured to cover at least a portion of a first breast of the wearer and each second cup is configured to cover at least a portion of a second breast of the wearer.

In some additional, alternative, or selectively cumulative embodiments, the first engagement surface and the first mating surface are attachable to each other by at least one of a first Velcro mechanism and a first hook and loop fastening mechanism. This helps form the bra template.

In some additional, alternative, or selectively cumulative embodiments, the second engagement surface and the second mating surface are attachable to each other by at least one of a second Velcro mechanism and a second hook and loop fastening mechanism. This helps form the bra template.

In some additional, alternative, or selectively cumulative embodiments, the first cups are of different first cup sizes, the second cups are of different second cup sizes, and the bra bands are of different bra band sizes. This enhances the modularity of the system.

In some additional, alternative, or selectively cumulative embodiments, the first cups include a common first cup shape, the second cups include a common second cup shape, and the bra bands include a common bra band shape. This helps form differently sized bra templates, but having similar overall shapes.

In some additional, alternative, or selectively cumulative embodiments, at least one of each first cup, each second cup, and each bra band are formed from a flexible material. The flexible material includes fabric.

DETAILED DESCRIPTION

Figure 1:
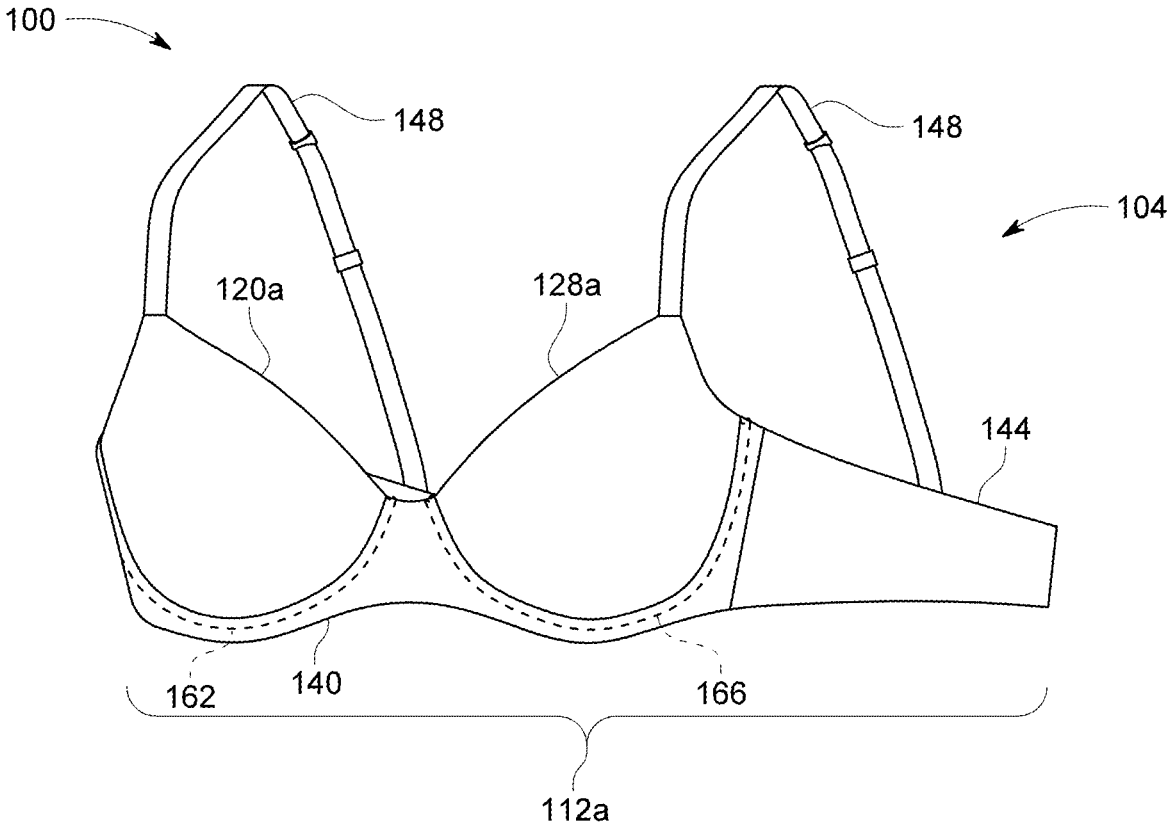
FIG. 1 is a front perspective view of an exemplary bra template of a system for creating a custom fit bra for a wearer, in accordance with an embodiment of the disclosure.
Figure 2:
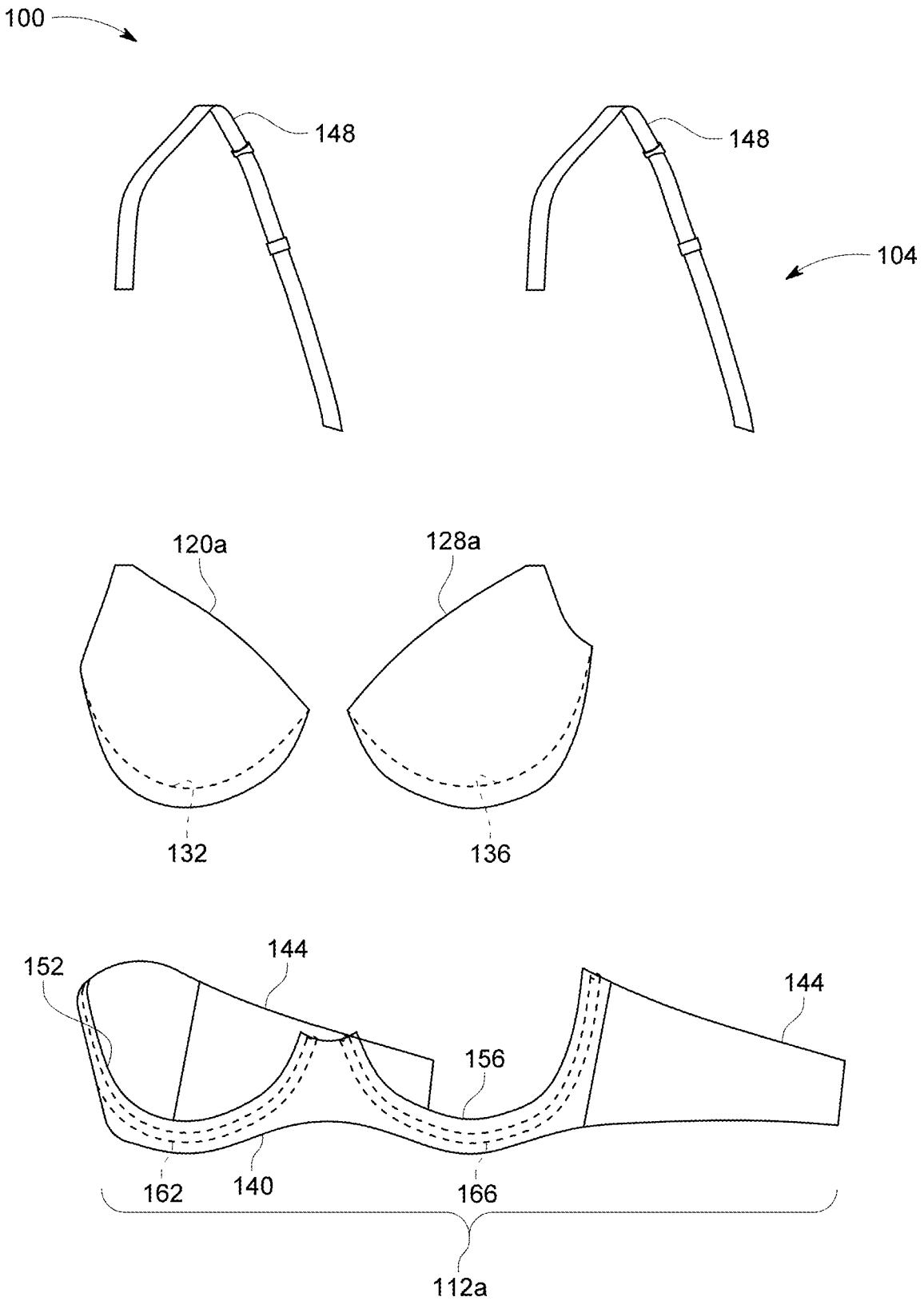
FIG. 2 is an exploded view of the bra template of FIG. 1, in accordance with an embodiment of the disclosure.

Example embodiments are described below with reference to the accompanying drawings. Unless otherwise expressly stated in the drawings, the sizes, positions, etc., of components, features, elements, etc., as well as any distances therebetween, are not necessarily to scale, and may be disproportionate and/or exaggerated for clarity.

The terminology used herein is for the purpose of describing particular example embodiments only and is not intended to be limiting. As used herein, the singular forms "a," "an" and "the" are intended to include the plural forms as well, unless the context clearly indicates otherwise. It should be recognized that the terms "comprise," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. Unless otherwise specified, a range of values, when recited, includes both the upper and lower limits of the range, as well as any sub-ranges therebetween. Unless indicated otherwise, terms such as "first," "second," etc., are only used to distinguish one element from another. For example, one element could be termed a "first element" and similarly, another element could be termed a "second element," or vice versa. The section headings used herein are for organizational purposes only and are not to be construed as limiting the subject matter described.

Unless indicated otherwise, the terms "about," "thereabout," "substantially," etc. mean that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art.

Spatially relative terms, such as "right," left," "below," "beneath," "lower," "above," and "upper," and the like, may be used herein for ease of description to describe one element's or feature's relationship to another element or feature, as illustrated in the drawings. It should be recognized that the spatially relative terms are intended to encompass different orientations in addition to the orientation depicted in the figures. For example, if an object in the figures is turned over, elements described as "below" or "beneath" other elements or features would then be oriented "above" the other elements or features. Thus, the term "below" can, for example, encompass both an orientation of above and below. An object may be otherwise oriented (e.g., rotated 90 degrees or at other orientations) and the spatially relative descriptors used herein may be interpreted accordingly.

Unless clearly indicated otherwise, all connections and all operative connections may be direct or indirect. Similarly, unless clearly indicated otherwise, all connections and all operative connections may be rigid or non-rigid.

Like numbers refer to like elements throughout. Thus, the same or similar numbers may be described with reference to other drawings even if they are neither mentioned nor described in the corresponding drawing. Also, even elements that are not denoted by reference numbers may be described with reference to other drawings.

Many different forms and embodiments are possible without deviating from the spirit and teachings of this disclosure and so this disclosure should not be construed as limited to the example embodiments set forth herein. Rather, these example embodiments are provided so that this disclosure will be thorough and complete, and will convey the scope of the disclosure to those skilled in the art.

Reference in this specification to "one embodiment" or "an embodiment" means that a particular feature, structure, or characteristic described in connection with the embodiment is included in at least one embodiment of the present disclosure. The appearance of the phrase "in one embodiment" in various places in the specification are not necessarily all referring to the same embodiment, nor are separate or alternative embodiments mutually exclusive of other embodiments.

Referring to FIGS. 1 through 4, a system 100 for creating a custom fit bra for a wearer is described. The system 100 may include a myriad of parts or segments and those segments have been illustrated across FIGS. 1 through 4, as shown. The annotation '100', as used in the FIGS. 1 through 4, can be representative of either a part of the system 100 or an entirety of the system 100. The system 100 will be well understood by viewing FIGS. 1 through 4, collectively.

The system 100 facilitates the formation of a bra template 104, as shown, and based on which the custom fit bra may be made or manufactured. To this end, the system 100 includes a plurality of bra bands (which may be collectively referred to as a bra band set 112, see FIG. 4), a plurality of first cups (which may be collectively referred to as a first cup set 120, see FIG. 3), and a plurality of second cups (which may be collectively referred to as a second cup set 128, see FIG. 3). For ease of reference and understanding, several discussions in the present disclosure can be directed towards a single bra band (e.g., bra band 112*a* of the bra band set 112, see FIGS. 1, 2, and 4), a single first cup (e.g., first cup 120*a* of the first cup set 120, see FIGS. 1, 2, and 3), and a single second cup (e.g., second cup 128*a* of the second cup set 128, see FIGS. 1, 2, and 3).

Figure 3:
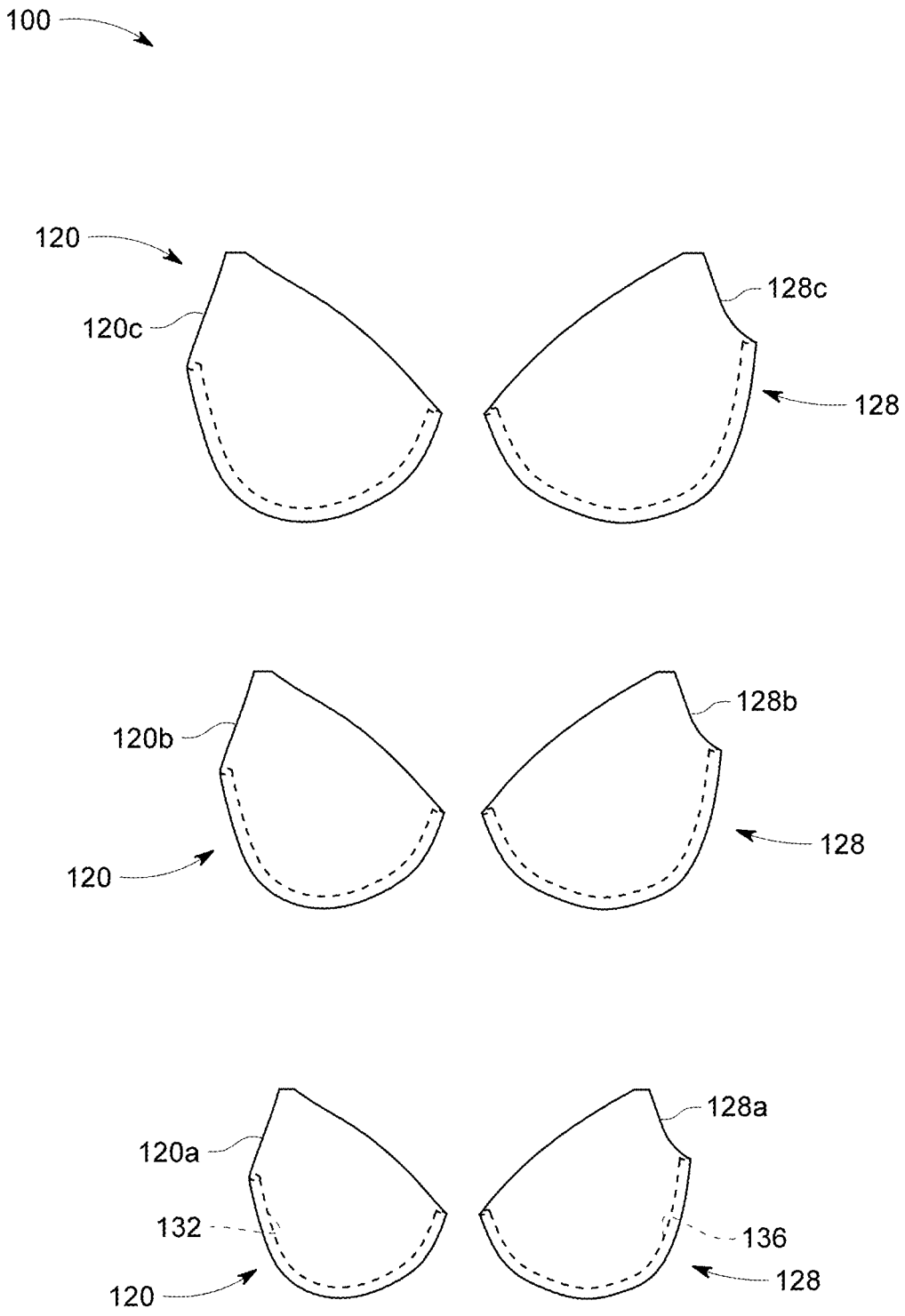
FIG. 3 is a view illustrating an exemplary variety of first cups and second cups of the system, in accordance with an embodiment of the disclosure.
Figure 4:
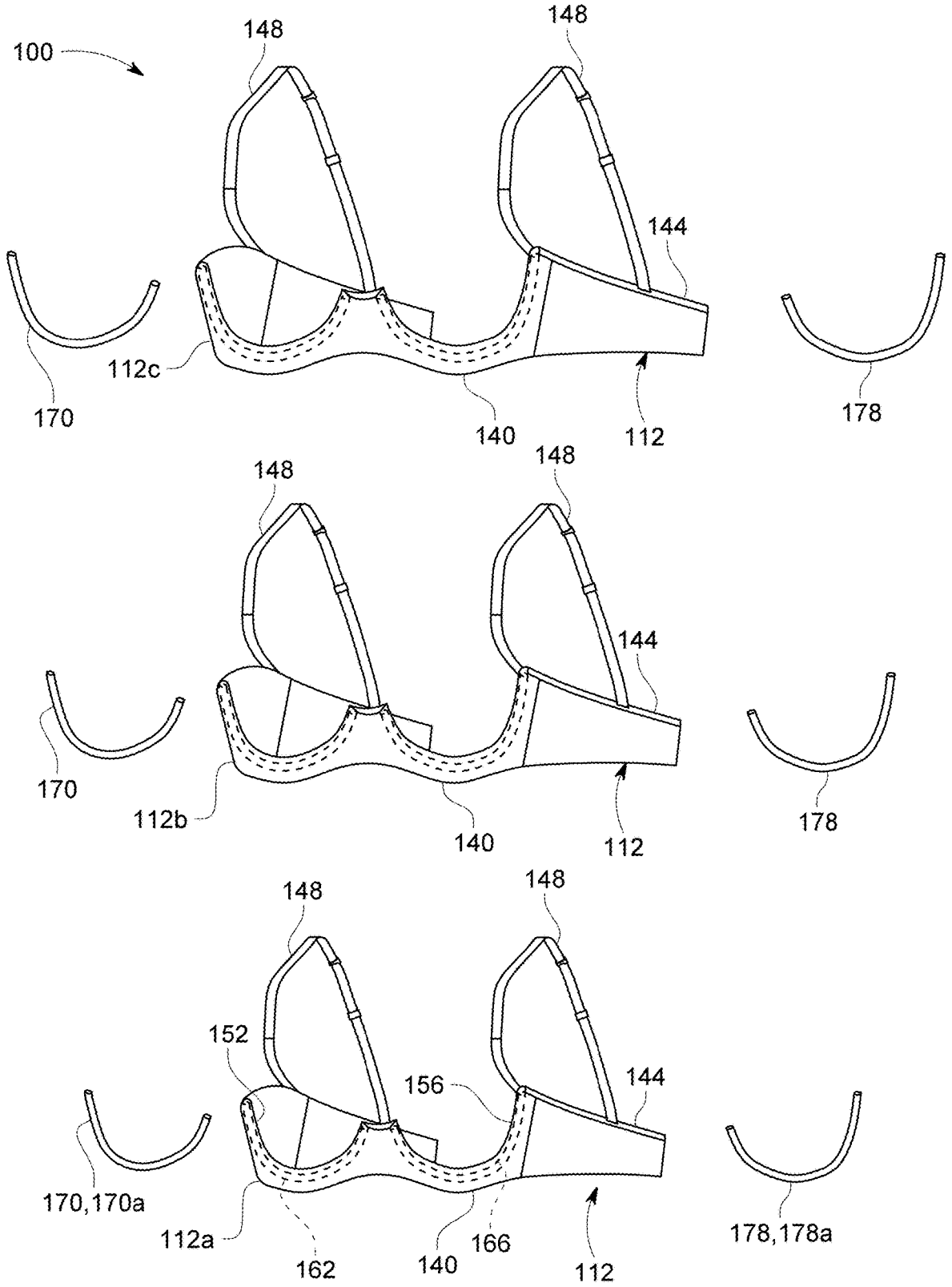
FIG. 4 is a view illustrating an exemplary variety of bra bands of the system, in accordance with an embodiment of the disclosure.

As shown in FIGS. 3 and 4, the bra band set 112 may include additional bra bands such as bra bands 112*b*, 112*c*, although a lesser or additional number of bra bands may be included in the bra band set 112. Similarly, the first cup set 120 may include additional first cups such as first cups 120*b*, 120*c*, although a lesser or additional number of first cups may be included in the first cup set 120. Also, similarly, the second cup set 120 may include additional second cups such as second cups 120*b*, 120*c*, although a lesser or additional number of second cups may be included in the second cup set 120.

Discussions or description corresponding to the bra band 112*a* may be suitably applicable to each of the bra bands (e.g., the bra bands 112*b*, 112*c*) of the bra band set 112; discussions or description corresponding to the first cup 120*a* may be suitably applicable to each of the first cups (e.g., the first cups 120*b*, 120*c*) of the first cup set 120; and discussions or description corresponding to the second cup 128*a* may be suitably applicable to each of the second cups (e.g., the second cups 128*b*, 128*c*) of the second cup set 128.

The first cup 120*a* may be made from a flexible material, such as fabric, polymer, nylon, and the like materials. The first cup 120*a* may be worn over a first breast of a wearer to cover at least a portion of the first breast of the wearer. As an example, the first breast may correspond to the wearer's right hand side breast. Moreover, references in the present description corresponding to "first", as applied for the system 100 and/or the bra template 104, may correspond to parts or portions of a body of the wearer that surrounds or relates to the wearer's right hand side breast.

In some embodiments, the first cup 120*a* can include a unique first identifier. The unique first identifier may provide an identity of the first cup 120*a*, indicating one or more of the first cup's size and/or the first cup's shape and/or the first cup's color, distinguishing the first cup 120*a* from other first cups (e.g., first cups 120*b*, 120*c*) of the first cup set 120. In some non-limiting examples, the unique first identifier may include one or more of a tag, a print, etc., on the first cup 120*a* and/or a sewn part, an engraved part, etc., formed on the first cup 120*a* that can highlight a unique code associated with the first cup 120*a*, and by way of which the first cup's unique size and/or shape can be ascertained. The first cup 120*a* may also define a first mating surface 132, as shown in FIG. 3.

The first cups in the first cup set 120 can be of different first cup sizes—for example, the first cup sizes can incrementally vary from a first size to a last size. It is possible for the first cups in the first cup set 120 to include a common or a same first cup shape, although one or more of the first cups from the first cup set 120 can include different first cup shapes and/or contours, as well. The common or same first cup shape, but with each first cup having different sizes, helps form differently sized bra templates having similar overall shapes.

As with the first cup, the second cup 128*a* may be made from a flexible material, such as fabric, polymer, nylon, and the like materials. The second cup 128*a* may be worn over a second breast of the wearer to cover at least a portion of the second breast of the wearer. As an example, the second breast may correspond to the wearer's left hand side breast. Moreover, references in the present description corresponding to "second", as applied for the system 100 and/or the bra template 104, may correspond to parts or portions of the body of the wearer that surrounds or relates to the wearer's left hand side breast.

As with the first cup 120*a*, in some embodiments, the second cup 128*a* can include a unique second identifier. The unique second identifier may provide an identity of the second cup 128*a*, indicating one or more of the second cup's size and/or the second cup's shape and/or the second cup's color, distinguishing the second cup 128*a* from other second cups (e.g., second cups 128*b*, 128*c*) of the second cup set 128. In some non-limiting examples, the unique second identifier may include one or more of a tag, a print, etc., on the second cup 128*a* and/or a sewn part, an engraved part, etc., formed on the second cup 128*a* that can highlight a unique code associated with the second cup 128*a*, and by way of which the second cup's unique size and/or shape can be ascertained. The second cup 128*a* may also define a second mating surface 136, as shown in FIG. 3.

The second cups in the second cup set 128 can be of different first cup sizes—for example, the second cup sizes can incrementally vary from a first size to a last size (e.g., to comply and correspond with the sizes of the first cups of the first cup set 120). It is possible for the second cups in the second cup set 128 to include a common or a same second cup shape (which in some cases may be similar but symmetrically opposed to the first cup shape), although one or more of the second cups from the second cup set 128 can include different second cup shapes and/or contours, as well. The common or same second cup shape, but with each second cup having different sizes, helps form differently sized bra templates having similar overall shapes.

The bra band 112*a* may be made from a flexible material, such as fabric, polymer, nylon, and the like materials, as well. The bra band 112*a* may include a frame 140 and a pair of wings 144 (also see FIG. 2). The frame 140 may be devoid of breast cups and thus may define curved contours (e.g., two curved contours) to respectively receive the first cup 120*a* and the second cup 128*a*. The pair of wings 144 may extend oppositely away from the frame 140 (and from each other, as shown) to be wrapped around a torso of the wearer. To this end, the pair of wings 144 may include fastening mechanisms, such as Velcro mechanisms, hook and loop fastening mechanism, and the like mechanisms, by way of which the pair of wings 144 may be connected to each other when wrapped around the wearer. Further, when the bra band 112*a* is worn, the bra band 112*a* may occupy a position under each of the first breast and second breast of the wearer.

As with the first cup 120*a* and the second cup 128*a*, the bra bands 112*a* in the bra band set 112 can be of different bra band sizes—for example, the bra band sizes can incrementally vary from a first size to a last size (e.g., to comply and correspond with the sizes of the first cups of the first cup set 120 and with the second cups of the second cup set 128). It is possible for the bra bands in the bra band set 112 to include a common or a same bra band shape, although one or more of the bra bands from the bra band set 112 can include different bra band shapes and/or contours, as well. The common or same bra band shape, but with each bra band having different sizes, helps form differently sized bra templates having similar overall shapes.

Further, the bra band 112*a* can include shoulder straps 148 that may be worn around the wearer's shoulder and connectable with the pair of wings 144 described above to retain the bra template 104, once formed, in place, e.g., around the torso of the wearer. A connection between the shoulder straps 148 and the pair of wings 144 may be attained by way of fastening mechanisms, such as Velcro mechanisms, hook and loop fastening mechanism, and the like mechanisms, as may be contemplated by someone skilled in the art. In some embodiments, the shoulder straps 148 may be permanently fixed with the frame 140.

Further, as with the first cup 120*a* and the second cup 128*a*, in some embodiments, the bra band 112*a* can include a unique bra band identifier. The unique bra band identifier may provide an identity of the bra band 112*a*, indicating one or more of the bra band's size and/or the bra band's shape and/or the bra band's color, distinguishing the bra band 112*a* from other bra bands (e.g., bra bands 112*b*, 112*c*) of the bra band set 112. In some non-limiting examples, the unique bra band identifier may include one or more of a tag, a print, etc., on the bra band 112*a* and/or a sewn part, an engraved part, etc., formed on the bra band 112*a* that can highlight a unique code associated with the bra band 112*a*, and by way of which the bra band's unique size and/or shape can be ascertained.

The frame 140 of the bra band 112*a* may also define a first engagement surface 152 and a second engagement surface 156 (see FIG. 4). The first engagement surface 152 and the second engagement surface 156 may be provided respectively along the two curved contours defined by the frame 140. The first engagement surface 152 and the first mating surface 132 can be coupled to each other by at least one of a first Velcro mechanism and a first hook and loop fastening mechanism. In that manner, the first mating surface 132 can be removably attachable to the first engagement surface 152 facilitating the first cups of the first cup set 120 to be interchangeably coupled with the frame 140 of each of the bra bands of the bra band set 112. Similarly, the second engagement surface 156 and the second mating surface 136 can be coupled to each other by at least one of a second Velcro mechanism and a second hook and loop fastening mechanism. In that manner, the second mating surface 136 can be removably attachable to the second engagement surface 156 facilitating the second cups of the second cup set 128 to be interchangeably coupled with the frame 140 of each of the bra bands of the bra band set 112.

In some embodiments, the bra band 112*a* can include a first slot 162 and a second slot 166. Both the first slot 162 and the second slot 166 can be arcuate slots that respectively travel along the two curved contours of the frame 140 correspondingly receivable of the first cup 120*a* and the second cup 128*a*. The first slot 162 can be located adjacent to the first engagement surface 152, as shown, and the second slot 166 can be located adjacent to the second engagement surface 156, as shown. Further, the first slot 162 may run, at least in part, along a length of the first engagement surface 152, while the second slot 166 may run, at least in part, along a length of the second engagement surface 156.

With continued reference to the slots 162, 166, in some embodiments, the system 100 may further include wires that can be inserted into the slots 162, 166. For example, the system 100 may include a plurality of first wires (also referrable to as a first wire set 170) and a plurality of second wires (also referrable to as a second wire set 178). The first wires and second wires can be of different sizes and shapes. At least one first wire (e.g., first wire 170*a*) of the first wire set 170 is insertable into the first slot 162 of the bra band 112*a*. Similarly, at least one second wire (e.g., second wire 178*a*) of the second wire set 178 is insertable into the second slot 166 of the bra band 112*a*. Both the first wire 170*a* and the second wire 178*a* may provide structural stability to the bra band 112*a*, e.g., to the frame 140 of the bra band 112*a*. Applications and purposes of other first wires of the first wire set 170 may remain similar to that of the first wire 170*a*. Similarly, applications and purposes of other second wires of the second wire set 178 may remain similar to that of the second wire 178*a*.

Also, as an example, the first wire 170*a* may differ in size relative to the other first wires in the first wire set 170. In this regard, the first wire 170*a* may include a unique first wire identifier to distinguish the first wire 170*a* from other first wires of the first wire set 170. In some non-limiting examples, the unique first wire identifier may include one or more of a tag, a print, etc., on the first wire 170*a* and/or an engraved part, etc., formed on the first wire 170*a* that can highlight a unique code associated with the first wire 170*a*, and by way of which the first wire's unique size and/or shape can be ascertained.

Likewise, the second wire 178*a* may differ in size relative to the other second wires in the second wire set 178. In this regard, the second wire 178*a* may include a unique second wire identifier to distinguish the second wire 178*a* from other second wires of the second wire set 178. In some non-limiting examples, the unique second wire identifier may include one or more of a tag, a print, etc., on the second wire 178*a* and/or an engraved part, etc., formed on the second wire 178*a* that can highlight a unique code associated with the second wire 178*a*, and by way of which the second wire's unique size and/or shape can be ascertained. It will be appreciated that the wires, e.g., the first wire set 170 and the second wire set 178, as described above, can be optional elements of the system 100, and they may be omitted from the system 100, in some cases.

It will be appreciated that the first cups of the first cup set 120, the second cups of the second cup set 128, and a the bra bands of the bra band set 112 allows the wearer to determine a combination of segments of the system 100, or, more particularly, of a first cup (e.g., the first cup 120*a*) from the first cup set 120, a second cup (e.g., the second cup 128*a*) from the second cup set 128, and a bra band (e.g., the bra band 112*a*) from the bra band set 112, that best fits the wearer. This enables the custom fit bra to be produced for the wearer based on said combination of the segments of the system 100, e.g., based on the first cup 120*a*, the second cup 128*a*, and the bra band 112*a*. It may be noted that the combination of the segments of the system 100, e.g., the first cup 120*a*, the second cup 128*a*, and the bra band 112*a*, once assembled together, may form the bra template 104. The bra template 104 illustrated in FIGS. 1 and 2 exemplarily indicate an application of the first cup 120*a* and the second cup 128*a* with the bra band 112*a*. based on the wearer's need. It is possible for the other first cups of the first cup set 120 and the other second cups of the second cup set 128 to be applied with the bra band 112*a* instead, to form the bra template 104.

Effectively, during an application of the system 100, or as part of a method for creating a custom fit bra for the wearer, the wearer may use each of the first cup set 120, the second cup set 128, and the bra band set 112. In particular, the wearer may determine a combination of a first cup (e.g., the first cup 120*a*) from the first cup set 120, a second cup (e.g., the second cup 128*a*) from the second cup set 128, and a bra band (e.g., the bra band 112*a*) from the bra band set 112, to form and/or arrive at the bra template 104 that best fits the wearer, such that the custom fit bra may be built and/or created based on the bra template 104.

According to an exemplary procedure, the wearer may select and determine an appropriately sized bra band (e.g., bra band 112*a*) from the bra band set 112. Thereafter, the wearer may use the first wire set 170 and the second wire set 178. In this regard, the wearer may select a suitably sized first wire (e.g., the first wire 170*a*) from the first wire set 170 and insert said first wire 170*a* into the first slot 162 of the bra band 112*a* (see FIG. 4). Similarly, the wearer may select a suitably sized second wire (e.g., the second wire 178*a*) from the second wire set 178 and insert said second wire 178*a* into the second slot 166 of the bra band 112*a* (see FIG. 4). Both the first wire 170*a* and the second wire 178*a* may impart and/or enhance the structural stability of the bra band 112*a*, while also complying with the sizes of the wearer's breasts. As discussed above, the wires can be optional elements of the system 100, and may be omitted from the system 100 in some cases.

Next, the wearer may select and determine an appropriately sized first cup (e.g., the first cup 120*a*) from the first cup set 120 and an appropriately sized second cup (e.g., the second cup 128*a*) from the second cup set 128. Once the first cup 120*a*, the second cup 128*a*, along with the bra band 112*a*, have been selected and/or determined, the wearer may couple the first cup 120*a* and the second cup 128*a* with the bra band 112*a*. M ore particularly, the first mating surface 132 may be adhered and/or attached to the first engagement surface 152, e.g., by the first Velcro mechanism and/or the first hook and loop fastening mechanism. Similarly, the second mating surface 136 may be adhered and/or attached to the second engagement surface 156, e.g., by the second Velcro mechanism and/or the second hook and loop fastening mechanism. In that manner, a fully prepared bra template (e.g., the bra template 104) may be prepared. The wearer at this stage, or intermediately to any stage described above, may wear the bra template 104, or its portions thereof (e.g., one or more of the segments of the combination or the bra template 104, thus formed) to ascertain whether the bra template and/or one or more of the segments of said bra template 104 fit properly and/or aesthetically deem well with the wearer's body.

As an example, if the first cup 120*a* doesn't fit well against the wearer's first breast, the wearer may select another first cup from the remaining first cups of the first cup set 120 to determine the first cup that fits best against the wearer's first breast to form the bra template 104. Similarly, if the second cup 128*a* doesn't fit well against the wearer's second breast, the wearer may select another second cup from the remaining second cups of the second cup set to determine the second cup that fits best against the wearer's second breast to form the bra template 104. Also, if the bra band 112*a* doesn't fit well against the wearer's torso and/or rib cage, the wearer may select another bra band from the remaining bra bands of the bra band set 112 to determine the bra band that fits best against the wearer's torso and/or rib cage to form the bra template 104. Effectively, the wearer may apply any number of possible combinations of a first cup, a second cup, and a bra band to arrive at the bra template 104, enhancing the modularity of the system 100.

Once the combination of the segments of the system 100 and/or the bra template 104 is finalized, the wearer may record the unique first identifier associated with the finalized first cup (e.g., the first cup 120*a*), the unique second identifier associated with the finalized second cup (e.g., the second cup 128*a*), and the unique bra band identifier associated with the finalized bra band (e.g., the bra band 112*a*). The unique first identifier, the unique second identifier, and the unique bra band identifier may then be delivered to a manufacturer for the production or creation of the custom fit bra.

Since different wearers include different torso or rib cage sizes and/or breast volumes (including both right and left breast volumes), the system 100 allows for an easy and modular manner for preparing a custom fit bra. This is enabled by way of preparing the bra template 104 based on the finalized first cup (e.g., the first cup 120*a*), finalized second cup (e.g., the second cup 128*a*), and the finalized bra band (e.g., the bra band 112*a*), that best fits the wearer, and based on which a custom fit bra can be made or manufactured for the wearer. The system 100 negates the need to acquire multiple bras that may otherwise be needed to be tried on by the wearer, at times repeatedly or in quick succession, to arrive at the best fit bra, thus saving time, costs, and effort.

It should be understood that the foregoing description is only illustrative of the aspects of the disclosed embodiments. Various alternatives and modifications can be devised by those skilled in the art without departing from the aspects of the disclosed embodiments.

What is claimed:

1. A system for creating a custom fit bra for a wearer, the system comprising:

a plurality of bra bands, wherein each bra band of the plurality of bra bands has a different shape and different contour, and each bra band of the plurality of bra bands includes:

a frame and a pair of wings extending oppositely away from the frame to be wrapped around a torso of the wearer, the frame defining a first engagement surface and a second engagement surface, and a first slot adjacent to the first engagement surface and a second slot adjacent to the second engagement surface;

a plurality of first wires, wherein at least one first wire of the plurality of first wires is insertable into the first slot of the corresponding bra band to provide structural stability to the corresponding bra band;

a plurality of first cups, wherein each first cup of the plurality of first cups defining a first mating surface removably attachable to the first engagement surface facilitating the plurality of first cups to be interchangeably coupled with the frame associated with each bra band of the plurality of bra bands; and a plurality of second cups, wherein each second cup of the plurality of second cups defining a second mating surface removably attachable to the second engagement surface facilitating the plurality of second cups to be interchangeably coupled with the frame associated with each bra band of the plurality of bra bands.

2. The system of claim 1, further comprising:

a plurality of second wires, wherein at least one second wire of the plurality of second wires is insertable into the second slot of the corresponding bra band to provide structural stability to the corresponding bra band.

3. The system of claim 1, wherein the plurality of first cups, the plurality of second cups, and the plurality of bra bands, allows the wearer to determine a combination of a first cup from the plurality of first cups, a second cup from the plurality of second cups, and a bra band from the plurality of bra bands, that best fits the wearer, enabling the custom fit bra to be produced for the wearer based on the combination of the first cup, the second cup, and the bra band.

4. The system of claim 1, wherein each first cup includes a first identifier, each second cup incudes a second identifier, and each bra band includes a bra band identifier, and wherein the first identifier, the second identifier, and the bra band identifier are different from each other.

5. The system of claim 1, wherein each first cup is configured to cover at least a portion of a first breast of the wearer and each second cup is configured to cover at least a portion of a second breast of the wearer.

6. The system of claim 1, wherein the first engagement surface and the first mating surface are attachable to each other by at least one of a first hook and loop fastening mechanism.

7. The system of claim 1, wherein the second engagement surface and the second mating surface are attachable to each other by at least one of a second hook and loop fastening mechanism.

8. The system of claim 1, wherein the plurality of first cups is of different first cup sizes, the plurality of second cups is of different second cup sizes, and the plurality of bra bands is of different bra band sizes.

9. The system of claim 1, wherein the plurality of first cups includes a common first cup shape, the plurality of second cups includes a common second cup shape, and the plurality of bra bands includes a common bra band shape.

10. The system of claim 1, wherein at least one of each first cup, each second cup, and each bra band are formed from a flexible material, wherein the flexible material includes fabric.

11. A method for creating a custom fit bra for a wearer, the method comprising:

using a plurality of bra bands, wherein each bra band of the plurality of bra bands has a different shape and different contour, and each bra band of the plurality of bra bands includes:

a frame and a pair of wings extending oppositely away from the frame to be wrapped around a torso of the wearer, the frame defining a first engagement surface and a second engagement surface, and a first slot adjacent to the first engagement surface and a second slot adjacent to the second engagement surface;

using a plurality of first wires, wherein at least one first wire of the plurality of first wires is insertable into the first slot of the corresponding bra band to provide structural stability to the corresponding bra band;

using a plurality of first cups, wherein each first cup of the plurality of first cups defining a first mating surface removably attachable to the first engagement surface facilitating the plurality of first cups to be interchangeably coupled with the frame associated with each bra band of the plurality of bra bands; and using a plurality of second cups, wherein each second cup of the plurality of second cups defining a second mating surface removably attachable to the second engagement surface facilitating the plurality of second cups to be interchangeably coupled with the frame associated with each bra band of the plurality of bra bands.

12. The method of claim 11, further comprising:

determining a combination of a first cup from the plurality of first cups, a second cup from the plurality of second cups, and a bra band from the plurality of bra bands, that best fits the wearer, and manufacturing the custom fit bra based on the combination of the first cup, the second cup, and the bra band.

13. The method of claim 11, further comprising:

using a plurality of second wires, wherein at least one second wire of the plurality of second wires is insertable into the second slot of the corresponding bra band to provide structural stability to the corresponding bra band.

14. The method of claim 11, wherein each first cup includes a first identifier, each second cup incudes a second identifier, and each bra band includes a bra band identifier, wherein the first identifier, the second identifier, and the bra band identifier are different from each other.

15. The method of claim 11, wherein each first cup is configured to cover at least a portion of a first breast of the wearer and each second cup at least a portion of a second breast of the wearer.

16. The method of claim 11, wherein the first engagement surface and the first mating surface are attachable to each other by at least one of a first hook and loop fastening mechanism.

17. The method of claim 11, wherein the second engagement surface and the second mating surface are attachable to each other by at least one of a second hook and loop fastening mechanism.

18. The method of claim 11, wherein the plurality of first cups is of different first cup sizes, the plurality of second cups is of different second cup sizes, and the plurality of bra bands is of different bra band sizes.

19. The method of claim 11, wherein the plurality of first cups includes a common first cup shape, the plurality of second cups includes a common second cup shape, and the plurality of bra bands includes a common bra band shape.

20. The method of claim 11, wherein at least one of each first cup, each second cup, and each bra band are formed from a flexible material, wherein the flexible material includes fabric.

* * * * *